US010746379B2

(12) United States Patent
Nijkamp

(10) Patent No.: US 10,746,379 B2
(45) Date of Patent: Aug. 18, 2020

(54) LUMINAIRE HAVING PLIABLE CONTAINER WITH RESTRICTING LIGHT EXIT STRUCTURE AND MANUFACTURING METHOD THEROF

(71) Applicant: SIGNIFY HOLDING B.V., Eindhoven (NL)

(72) Inventor: Rick Gerhardus Nijkamp, Eindhoven (NL)

(73) Assignee: SIGNIFY HOLDING B.V., Eindhoven (NL)

( * ) Notice: Subject to any disclaimer, the term of this patent is extended or adjusted under 35 U.S.C. 154(b) by 0 days.

(21) Appl. No.: 15/752,959

(22) PCT Filed: Aug. 8, 2016

(86) PCT No.: PCT/EP2016/068870
§ 371 (c)(1),
(2) Date: Feb. 15, 2018

(87) PCT Pub. No.: WO2017/029147
PCT Pub. Date: Feb. 23, 2017

(65) Prior Publication Data

US 2018/0259161 A1 Sep. 13, 2018

(30) Foreign Application Priority Data

Aug. 20, 2015 (EP) ..... 15181778

(51) Int. Cl.

| | |
|---|---|
| ***F21V 15/01*** | (2006.01) |
| ***F21S 8/04*** | (2006.01) |
| ***F21S 8/02*** | (2006.01) |
| ***F21V 17/00*** | (2006.01) |
| ***F21V 7/04*** | (2006.01) |

(Continued)

(52) U.S. Cl.
CPC ..... *F21V 15/012* (2013.01); *F21S 8/026* (2013.01); *F21S 8/04* (2013.01); *F21V 7/04* (2013.01); *F21V 17/007* (2013.01); *F21V 17/16* (2013.01); *F21V 23/005* (2013.01); *F21V 29/503* (2015.01); *F21Y 2115/10* (2016.08)

(58) Field of Classification Search
CPC ..... F21V 15/012; F21V 17/16; F21V 7/22; F21S 8/026
See application file for complete search history.

(56) References Cited

U.S. PATENT DOCUMENTS 4,490,776 A 12/1984 Kluch
5,584,566 A * 12/1996 Bowman ..... F21S 2/00 362/220

(Continued)

FOREIGN PATENT DOCUMENTS

EP 0173626 A1 3/1986
EP 2573461 A1 3/2013

(Continued)

*Primary Examiner* — Alexander K Garlen
(74) *Attorney, Agent, or Firm* — Daniel J. Piotrowski

(57) ABSTRACT

Disclosed is a luminaire (10) comprising a luminaire housing delimited by a light exit structure (20) engaging with an edge of a pliable container (30), wherein the container is structurally reinforced, i.e. rendered less pliable, by its engagement with the light exit structure; and at least one light engine (40) disposed within the luminaire housing. A method of manufacturing such a luminaire is also disclosed.

16 Claims, 6 Drawing Sheets

(51) Int. Cl.

| | |
|---|---|
| ***F21V 17/16*** | (2006.01) |
| ***F21V 29/503*** | (2015.01) |
| ***F21Y 115/10*** | (2016.01) |
| ***F21V 23/00*** | (2015.01) |

(56) References Cited

U.S. PATENT DOCUMENTS

| | | | | |
|---|---|---|---|---|
| 5,782,551 | A | 7/1998 | Capaul | |
| 9,816,681 | B1 * | 11/2017 | Householder | F21V 7/18 |
| 2006/0268559 | A1 | 11/2006 | Sferra et al. | |
| 2009/0316383 | A1 * | 12/2009 | Son | F21V 14/006 362/84 |
| 2010/0157610 | A1 * | 6/2010 | Xiao | F21V 15/013 362/370 |
| 2012/0051050 | A1 * | 3/2012 | Lee | F21S 2/005 362/235 |
| 2012/0262918 | A1 | 10/2012 | Delhorme et al. | |
| 2013/0155694 | A1 | 6/2013 | Hanacek | |
| 2013/0286637 | A1 * | 10/2013 | Lay | F21K 9/17 362/147 |
| 2014/0036498 | A1 * | 2/2014 | Lee | F21S 2/005 362/235 |
| 2014/0362566 | A1 | 12/2014 | Tischler et al. | |
| 2015/0292719 | A1 * | 10/2015 | Park | F21V 21/049 362/221 |

FOREIGN PATENT DOCUMENTS

| | | | |
|---|---|---|---|
| WO | WO2012042429 | A2 | 4/2012 |
| WO | WO2012042529 | A1 | 4/2012 |
| WO | WO2014155224 | A1 | 10/2014 |
| WO | WO2014155237 | A1 | 10/2014 |

* cited by examiner

LUMINAIRE HAVING PLIABLE CONTAINER WITH RESTRICTING LIGHT EXIT STRUCTURE AND MANUFACTURING METHOD THEROF

CROSS-REFERENCE TO PRIOR APPLICATIONS

This application is the U.S. National Phase application under 35 U.S.C. § 371 of International Application No. PCT/EP2016/068870, filed on Aug. 8, 2016, which claims the benefit of European Patent Application No. 15181778.0, filed on Aug. 20, 2015. These applications are hereby incorporated by reference herein.

FIELD OF THE INVENTION

The present invention relates to a luminaire comprising a luminaire housing having at least one light engine being disposed within, wherein the luminaire housing is delimited by a light exit structure and a container engaging with the light exit structure.

The present invention further relates to a method of manufacturing such a luminaire.

BACKGROUND OF THE INVENTION

Luminaires are electrical devices for creating artificial light by using one or more light engines, e.g. electrical lamps such as fluorescent lamps, halogen lamps, solid state lighting (SSL) elements such as LEDs, and so on. Examples of luminaires include, but are not limited to, large-area office troffers, down lights, and so on. Such luminaires typically comprise a housing delimited by a light exit structure and a cover. In order to provide the luminaires with the desired mechanical strength or rigidity, the cover is typically made of a rigid metal structure shaped, e.g. folded, in a desired shape such as a metal box or the like. An example of such a luminaire is disclosed in US 2012/0262918 A1 which has a cover or receptacle having at least a bottom made of aluminium, copper or stainless steel.

A particular challenge luminaire manufacturers are facing is to reduce the manufacturing cost of such devices. The cost is typically dominated by the cost of the light engine(s) and the cost of the cover. Where the one or more light engines are SSL elements, cost reductions are provided by the on-going development of such light engines, i.e. the maturation of the SSL element industry. However, it is less straightforward to reduce the cost of the cover, as its cost is typically dominated by its manufacturing process, i.e. the efforts involved to shape or mold the cover in its desired shape.

SUMMARY OF THE INVENTION

The present invention seeks to provide a more cost-effective luminaire.

The present invention further seeks to provide a more cost-effective method of manufacturing a luminaire.

According to an aspect, there is provided a luminaire comprising a luminaire housing having at least one light engine mounted thereon. The luminaire housing is delimited by a light exit structure and a container. The container has a flange surrounding an opening of the container, and the flange is engaged with the light exit structure. The container is a pliable container, and the engagement between the container and the light exit structure is such that it restricts the pliability of the container.

The present invention is based on the insight that the container or cover of such a luminaire can be made of a 'flimsy' material, that is, the container can be a pliable structure that can relatively easily be deformed, as the luminaire can derive its structural integrity from the engagement of the container with the light exit structure. By engaging the container with the light exit structure, e.g. affixing the container to the light exit structure, the degrees of freedom of the container are limited or curtailed, such that the container is structurally reinforced by its engagement with the light exit structure. To this end, the container merely has to be self-supporting, i.e. supporting its own weight and the weight of any component mounted thereon, e.g. within the luminaire housing. This has the advantage that the container can be manufactured using straightforward manufacturing techniques that do not require the time-consuming and costly shaping or molding of a rigid container from which the luminaire housing derives its structural integrity, as is the case in the prior art. This therefore can significantly reduce the cost of the luminaire.

For example, the container may be made of a flexible film or sheet; or a plant fiber-based material, e.g. a pulp. The flexible film or sheet for instance may be a polymer film or sheet or a metal film or sheet. The plant-fiber based material for instance may include pulped materials, such as an egg box-like container, a wood/paper-based container, a straw-based container, a sugar cane-based container, corrugated cardboard container or the like. Other materials, e.g. more bulky materials such as deformable or rigid foam-based materials, may equally be contemplated.

In an embodiment, the container comprises a plurality of reinforcement ribs to increase the structural integrity of the container.

The light exit window may be a rigid light exit structure selected from a translucent or transparent sheet made of glass or a polymer material. Glass is particularly preferred for its rigidity, as well as for its low cost, quality look and feel, and its ability to act as a fire barrier.

The translucent or transparent sheet may comprise or carry at least one optical element for altering a luminous distribution of the at least one light engine, such as for example one or more lenses, collimators, prisms, diffusers, light blocking elements such as reflectors or combinations thereof. The at least one optical element is preferably comprised by the translucent or transparent sheet as this obviates the need for separate optical components, which reduces the manufacturing cost of the luminaire.

Alternatively, the rigid light exit structure may comprise a rigid frame including a raster of reflective segments in order to redistribute the luminous output of the one or more light engines of the luminaire, e.g. to generate a homogeneous luminous distribution in a room into which the luminaire is fitted.

Alternatively, the light exit structure may also be pliable, its pliability being restricted by the engagement with the container edge.

The container may have a reflective inner surface facing the light exit structure to increase the optical efficiency of the luminaire. For example, the at least one light engine may be mounted on the light exit structure and arranged to direct its luminous output towards the reflective inner surface of the container. This has the advantage that a good luminous output yield may be achieved by indirect illumination of the light exit structure, thereby preventing or at least reducing glare issues because the at least one light engine cannot be directly observed.

Alternatively, the container may comprise a main surface opposite the light exit structure and at least one side surface extending from the main surface to the light exit structure, wherein the at least one light engine is mounted on one of the main surface and the at least one side surface, e.g. to provide an edge-lit or a direct lit light exit structure.

In an embodiment, the container comprises a first region and a second region, the first region having a greater thickness than the second region. Such greater thickness regions for instance may serve as structurally reinforced areas for mounting a device, e.g. a light engine or driver, thereon, thus further improving the structural integrity of the container and the luminaire housing.

In an embodiment, the luminaire comprises a first luminaire volume delimited by a first region of the light exit structure and a first portion of the container or a first container; a second luminaire volume spatially separated from the first luminaire volume and delimited by a second region of the light exit structure and a second portion of the container or a second container; a first light engine disposed in the first luminaire volume; and a second light engine disposed in the second luminaire volume. This for instance facilitates the emission of light from the first and second regions of the light exit structure, which may be used to create a particular aesthetic lighting effect.

The luminaire may further comprise at least one fixing member affixing the light exit structure to the container. Advantageously, the at least one fixing member covers a perimeter of the light exit structure to protect the perimeter, i.e. exposed edge, of the light exit structure from accidental damage. This is particularly relevant where the light exit structure comprises a glass sheet, which although rigid, can easily crack or shatter upon impact. Examples of suitable fixing members include one or more clamps, screws, a rubber, resin or foam seal, adhesive or adhesive tape, and so on.

In an embodiment, the container contains a flange portion folded around the perimeter of the light exit structure to secure the cover on the light exit structure and protect its perimeter from accidental damage. This has the advantage that the use of separate fixing members may be avoided if desired to further reduce the cost of the luminaire.

In the above embodiments, the light engines preferably are SSL elements although the invention is not limited thereto.

According to another aspect, there is provided a method of manufacturing a luminaire, comprising shaping a pliable container of a material selected from a thin film or sheet or a plant fiber-based material, the pliable container having a flange surrounding an opening in the container; providing a light exit structure; mounting at least one light engine on the container and/or the light exit structure; and forming a luminaire housing by engaging the flange of the container with the light exit structure such that the pliability of the container is restricted by its engagement with the light exit structure, wherein the at least one light engine is enclosed by the luminaire housing.

This allows for the cost-effective manufacture of a luminaire that derives its structural integrity mainly from the engagement between the pliable container or covert and the light exit structure rather than from a rigid container as is the case in the prior art. This allows for the container to be shaped using straightforward and cost-effective manufacturing techniques such as for example but not limited to blistering, thermoforming, deep drawing, vacuum forming, injection molding, pressure molding and so on.

BRIEF DESCRIPTION OF THE DRAWINGS

Embodiments of the invention are described in more detail and by way of non-limiting examples with reference to the accompanying drawings, wherein.

DETAILED DESCRIPTION OF THE EMBODIMENTS

Figure 1:
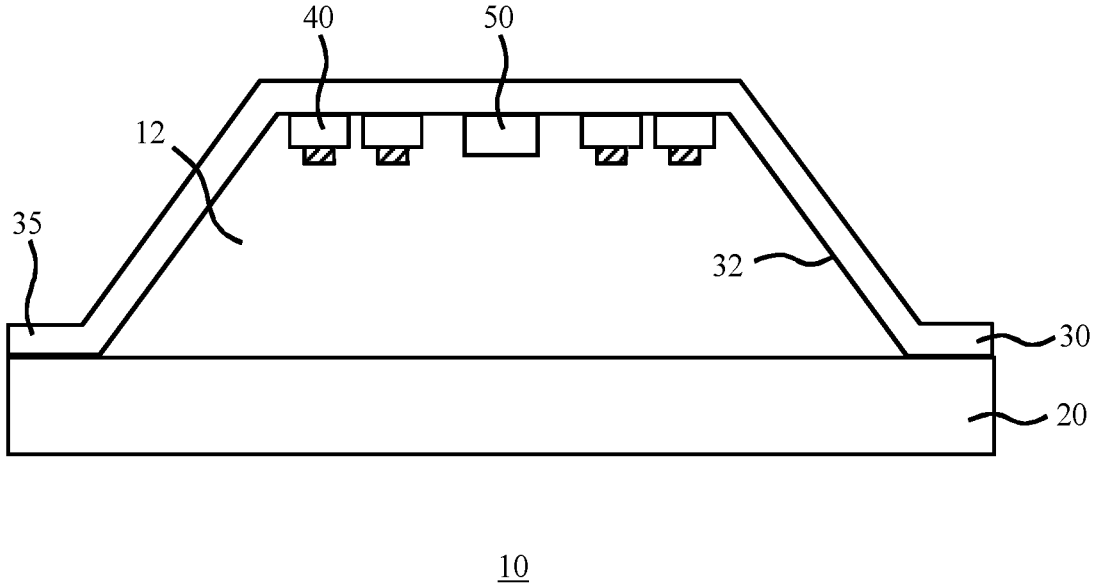
FIG. 1 schematically depicts a luminaire according to an example embodiment.

It should be understood that the Figures are merely schematic and are not drawn to scale. It should also be understood that the same reference numerals are used throughout the Figures to indicate the same or similar parts.

The present invention is based on the insight that whereas state-of-the-art of luminaires typically derive their structural integrity from a rigid cover that forms the housing of the luminaire together with the light exit structure such as a light exit window, causing the luminaire to become costly because of the manufacturing process of such a rigid cover, it is equally feasible to provide a structurally sound luminaire that derives its structural integrity from the engagement of a pliable container or cover with a light exit structure. Consequently, the luminaire container may be relatively flexible or deformable, with the luminaire cover being structurally reinforced, e.g. kept into shape or being made less flexible or deformable, by its engagement with the light exit structure. Such engagement for instance may connect an edge of the cover to the light exit structure, which limits the degrees of freedom of the edge of the cover such that the cover becomes more rigid. This principle for instance is known per se from flexible plastic food containers with a flexible lid, e.g. butter containers, wherein the engagement of a recess within the flexible lid with an edge of the flexible container restricts the flexibility of both the lid and the container due to the restriction of the degrees of freedom of both the lid and container by their engagement.

In at least some embodiments, the edge may extend from a main body of the luminaire container, e.g. form a flange or the like onto which the luminaire cover, e.g. a flat luminaire cover, may be mounted in order to form an engagement area defined by a region of the luminaire cover and the flange, which engagement area restricts the freedom of motion, e.g. the degree of deformation, of the luminaire cover.

In an embodiment, the deformable luminaire cover may include a substantially planar surface on which one or more components including one or more SSL elements are mounted. The deformable luminaire cover is dimensioned such that this substantially planar mounting surface exhibits an amount of sagging not exceeding 5% in order to avoid the surface appearing deformed. The sagging preferably is in a range of 1-5%, such as 3-5%. Sagging in the context of the present application is defined by an amount of out-of-plane deformation of a surface that is planar in the absence of a load relative to a maximum dimension of this surface. For example, for a load-free planar surface having a maximum dimension of 10 cm, its sagging under load should not exceed 5 mm. The maximum amount of sagging typically occurs in a central region of the substantially planar surface.

The container may be given its desirable properties by the use of suitable materials and/or by limiting the thickness of the container. Suitable materials may be selected based on some key material properties, such as for instance the Young's modulus of the material. In some embodiments, the Young's modulus of the container material may be 10 GPa or less, preferably 4 GPa or less when measured in accordance with the ASTM E111-04 standard.

In some embodiments, the container is designed such that it can only support its own weight and the weight of any of the components of the luminaire to be mounted thereon, e.g. one or more light engines, drivers, heat sink elements, and so on. As will be appreciated by the skilled person, the container thickness required to impart the desired properties onto the container will depend on the particular material used, as different materials having different intrinsic strengths. In some embodiments, the minimum thickness will be governed by optical rather than structural requirements; for example, when forming a container from a translucent (white) polymer, the thickness of the container may be chosen such that substantially no light escapes the luminaire through the container.

Based on this insight, many materials may be considered as the container material, including materials that are not suitable to provide a luminaire with its desired structural integrity, e.g. stiffness. The consideration may be driven by cost reduction requirements, e.g. by selecting materials that are low-cost and/or easily malleable, such that the container can be formed in a cost-effective manner, using straightforward manufacturing techniques.

For example, the container material may be selected from a metal or metal alloy sheet or foil, a polymer sheet or foil, polymer granules shaped into the desired cover shape by readily available shaping technologies such as for instance blistering, thermoforming, deep drawing, vacuum forming, injection molding, pressure molding, and so on, pressed or molded pulp materials based on plant fibers, such as egg box-like carton, wood or paper pulp materials, straw-based materials, sugar cane-based materials, and so on, or aerated container materials such as foam, corrugated cardboard, and so on.

The light exit structure preferably is an at least partially rigid light exit structure, in which at the least the part engaging with the edge of the pliable container is rigid to restrict the pliability of the container edge and the container as a whole as a consequence but the present invention is not limited thereto. It is equally feasible that the light exit structure is pliable or flexible, such that the engagement between the container edge and the light exit structure also restricts the pliability of the latter.

An example embodiment of a luminaire 10 is schematically depicted in FIG. 1. The luminaire 10 comprises a light exit structure 20 and a container 30 that combine to delimit a housing including a luminaire volume 12 housing a number of light engines 40 such as SSL elements, e.g. LEDs, and optionally further comprising additional components such as a driver 50 of the one or more light engines 40. As explained above, the container 30 typically has a relatively low structural integrity, e.g. may be pliable, deformable and/or flexible, and may be more pliable than the light exit structure 20, which may be at least partially rigid in at least some embodiments, and may have a structural integrity such that it is only capable of supporting its own weight and the weight of the components mounted on the inner surface 32 of the container 30 such as the one or more light engines 40 and the driver 50, although it is equally feasible that the driver 50 is located outside the luminaire volume 12. The inner surface 32 may be at least partially reflective, e.g. white reflective or specularly reflective. Preferably, the entire inner surface 32 is reflective to optimize the luminous efficiency of the luminaire 10. Although not specifically shown, the container 30 may further comprise one or more reinforcement structures such as reinforcement ribs that increase the resilience of the container 30. Such reinforcement structures may be located in any suitable location of the container 30, e.g. extend over an inner or outer surface of the container 30.

In FIG. 1, the light exit structure 20 is embodied by a light exit window such as a glass plate or a polymer plate, with the light exit window 20 being translucent, e.g. transparent. The light exit window 20 may provide the structural integrity of the luminaire volume 12 in case of a rigid light exit window 20 as the rigid light exit window 20 has greater structural integrity, e.g. greater rigidity or stiffness, than the container 30. This may be achieved by providing a light exit window 20 of an appropriate thickness. A glass plate or sheet as the rigid light exit structure 20 is particularly preferred as glass has suitable stiffness, has superior optical characteristics, is aesthetically pleasing and can act as a fire barrier in case of one of the components of the luminaire 10, e.g. a light engine 40 or driver 50 catching fire, e.g. through component failure, in which case a user is shielded or protected from the fire outbreak by the glass. This further applies to other fire sources behind the glass, e.g. fire sources external to the luminaire 10. In some embodiments, the light exit structure 20 is made of tempered glass or is provided with a transparent foil over a major surface of a glass light exit window to prevent shattering of the glass, thus providing additional safety.

In at least some embodiments, the light engines 40 comprise one or more SSL elements, e.g. LEDs, which may be mounted on a suitable carrier such as a PCB, e.g. in the form of a LED package, a COB assembly and so on. The conductive tracks on the carrier such as a PCB may be dimensioned such that they can also act as heat spreaders for the SSL elements mounted thereon, with the heat subsequently being dissipated by the luminaire housing. Other suitable thermal management solutions will be immediately apparent to the skilled person.

The luminaire 10 may further comprise one or more optical elements for shaping the luminous output of the one or more light engines 40, such as one or more diffusers, lenses, prisms, collimators, light guides, colour filters, light blocking elements, reflectors, and so on, or combinations thereof. The one or more optical elements may be separate to the light exit window 20 and may be mounted thereon or in any other suitable location within the luminaire 10. Alternatively, at least some of the one or more optical elements may be integral to the light exit window 20, thereby obviating the need for separate optical elements, which is more cost-effective.

In case of multiple light engines 40 in the luminaire 10, the light engines may be arranged to generate light of different colours, white light of different colour temperatures, and so on, with the luminaire volume 12 acting as a mixing chamber to mix the light from the different light engines 40 in order to produce a substantially homogeneous luminous output through the light exit structure 20, at least in terms of light colour. In case of multiple light engines 40 in the luminaire 10, the light engines 40 may be individually controllable to configure the luminous output of the luminaire 10. In such an embodiment, the luminaire 10 may further comprise a controller (not shown) for the light engines 40, which may be provided with a user control signal in any suitable manner, e.g. in wired or wireless fashion using a suitable user control signal generation device such as a wall-mounted user control signal generation device or a portable user control signal generation device, which may be a dedicated user control signal generation device or a multi-purpose mobile communication device such as a smart phone or tablet configured by software, e.g. an app, to implement the user control signal generation device.

The light exit structure 20 is typically dimensioned such that it can support the entire container 30. The container 30 may comprise an outer rim or flange 35 around an opening in the container 30 for contacting the light exit structure 20 to secure the container 30 on the light exit structure 20. The container 30, e.g. the outer rim or flange 35, may be affixed, i.e. immobilized, to the light exit structure 20 such that the engagement between the flange 35 of the container 30 and a corresponding region of the rigid light exit structure 20 enhances the structural integrity or rigidity of the container 30 due to the fact that the degrees of freedom of the container 30 are limited by the engagement. For example, where the outer rim or flange 35 is immobilized on the light exit structure 20, the shape of the outer rim or edge 35 can no longer change, such that the overall rigidity of the container 30 is increased by this engagement.

Figure 2:
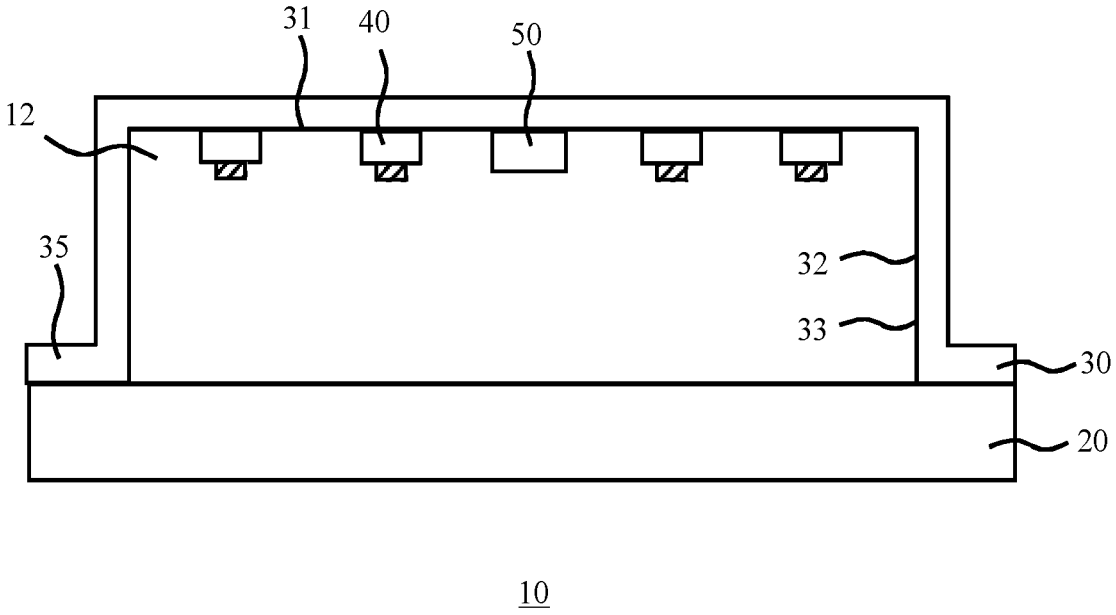
FIG. 2 schematically depicts a luminaire according to another example embodiment.

The shape of the container 30 is not particularly limited. In FIG. 1, the container 30 has a trapezoidal box shape. FIG. 2 depicts an alternative example embodiment in which the container 30 has a rectangular box shape with the components such as the one or more light engines 40 and the driver 50 mounted on a main surface 31 of the inner surface 32 that faces the rigid light exit structure 20, with the container 30 further comprising side surfaces 33 of the inner surface 32 extending from the main surface to the light exit structure 20 in perpendicular fashion. As before, at least part of the inner surface 32 of the container 30 may be reflective, e.g. parts of or the entire main surface 31 and/or of the side surfaces 33.

Figure 3:
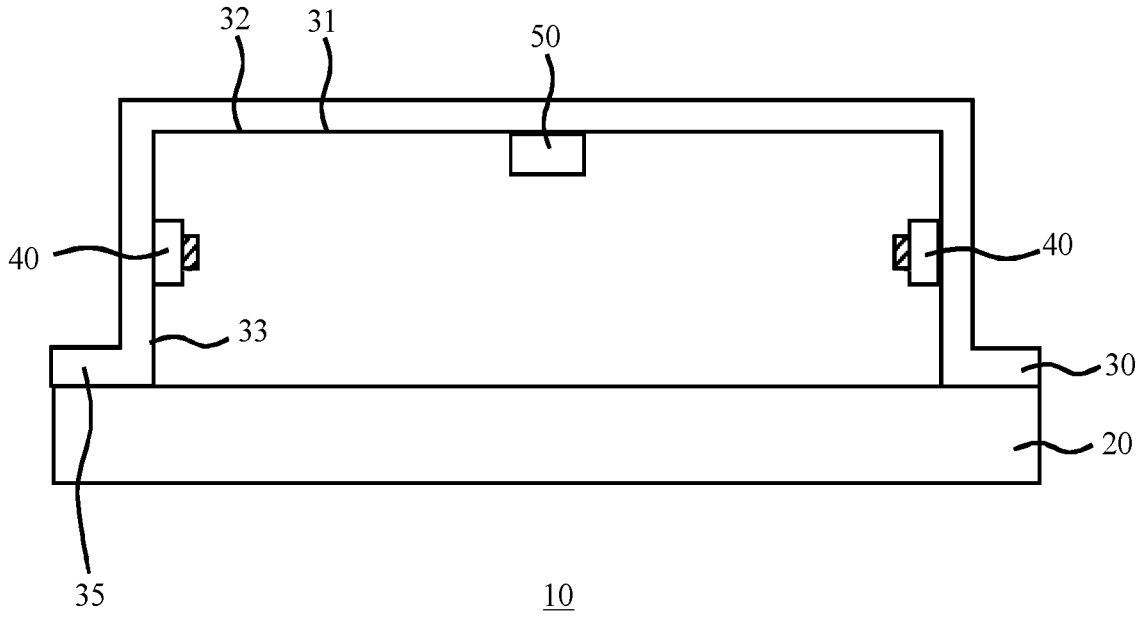
FIG. 3 schematically depicts a luminaire according to yet another example embodiment.

In FIGS. 1 and 2, a luminaire 10 is provided in which the light exit structure 20 is directly lit by the one or more light engines 40. FIG. 3 schematically depicts an alternative example embodiment in which a side-lit luminaire 10 is provided, with the one or more light engines 40 mounted on the side surface(s) 33 of the container 30. This for instance may be desirable to reduce glare associated with direct lit luminaires 10.

Figure 4:
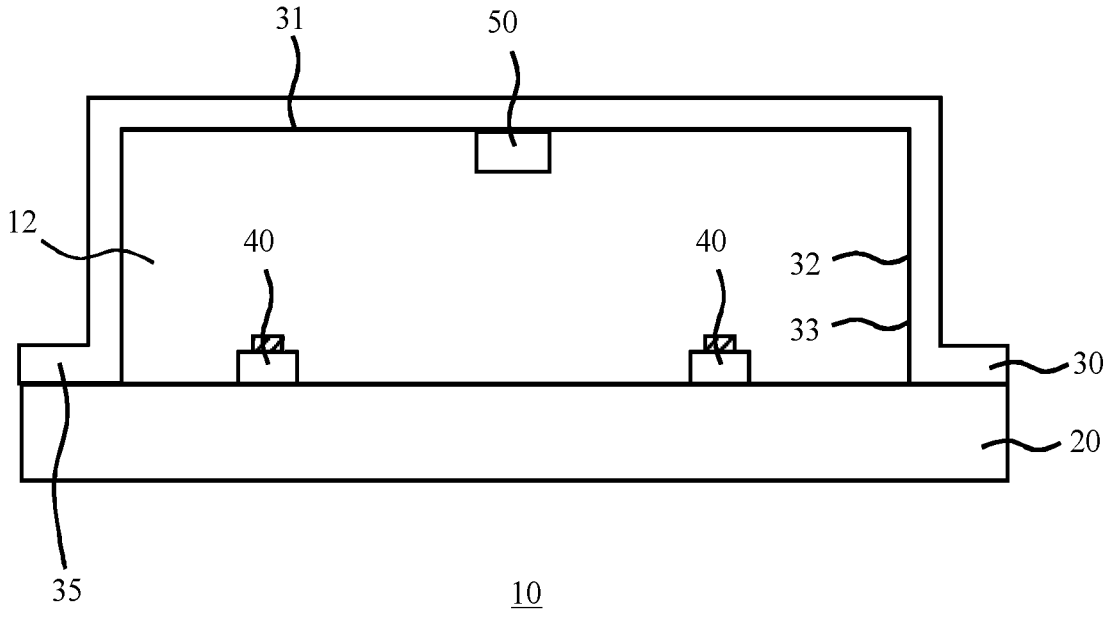
FIG. 4 schematically depicts a luminaire according to yet another example embodiment.

In FIG. 1-3, the light engines 40 are mounted on the inner surface 32 of the container 30. FIG. 4 schematically depicts an alternative example embodiment in which the one or more light engines 40 are mounted on the light exit structure 20 to provide an indirectly lit light exit structure 20 in which the light generated by the one or more light engines 40 is directed towards a reflective inner surface 32 of the container 30 and reflected back through the light exit structure 20. Such an indirect lit light exit structure 20 can suffer from shading generated thereon, which may be undesirable for aesthetic reasons. To this end, the light exit structure 20 may be a diffusive light exit structure 20 and/or may carry a light blocking pattern to alleviate such shading effects, e.g. by compensating for the shading effects or by camouflaging the shading effects.

Figure 5:
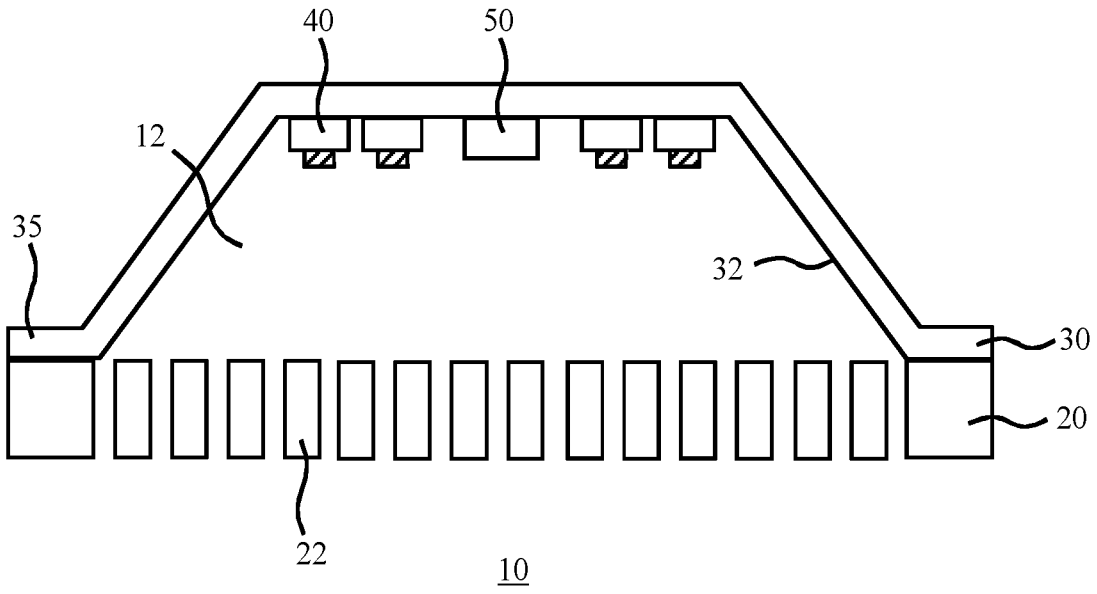
FIG. 5 schematically depicts a luminaire according to yet another example embodiment.

In FIG. 1-4, the luminaire 10 comprises a light exit structure 20 in the form of a rigid sheet or plate as explained above. FIG. 5 schematically depicts an alternative example embodiment in which the light exit structure 20 comprises a rigid frame delimiting a raster of reflective segments 22 that in turn delimit openings through which the luminous output of the one or more light engines 40 can escape the luminaire 10, either directly or through reflection by the reflective segments 22 in order to produce illumination over a large area, for instance when the luminaire 10 is a ceiling-mounted luminaire, e.g. is part of a modular ceiling such as a ceiling in a commercial space such as an office, shop, and so on. The rigid frame delimiting a raster of reflective segments 22 may be made of any suitable material. The rigid frame may be made of the same material as the reflective segments 22 although this is not strictly necessary. The rigid frame and the reflective segments 22 may be made of a metal or metal alloy, preferably a reflective metal or metal alloy, such as aluminium or the like, such that the segments 22 do not need an additional reflective coating such as a reflective paint or foil. The rim or flange 35 of the container 30 is typically engaged with the rigid frame of the rigid light exit structure 20 to enhance its structural integrity as previously explained. It is furthermore repeated for the avoidance of doubt that the light exit structure 20 is not necessarily rigid; the light exit structure 20 instead may exhibit a degree of pliability that is curtailed by the engagement of the light exit structure 20 with the rim or flange 35 of the container 30.

Figure 6:
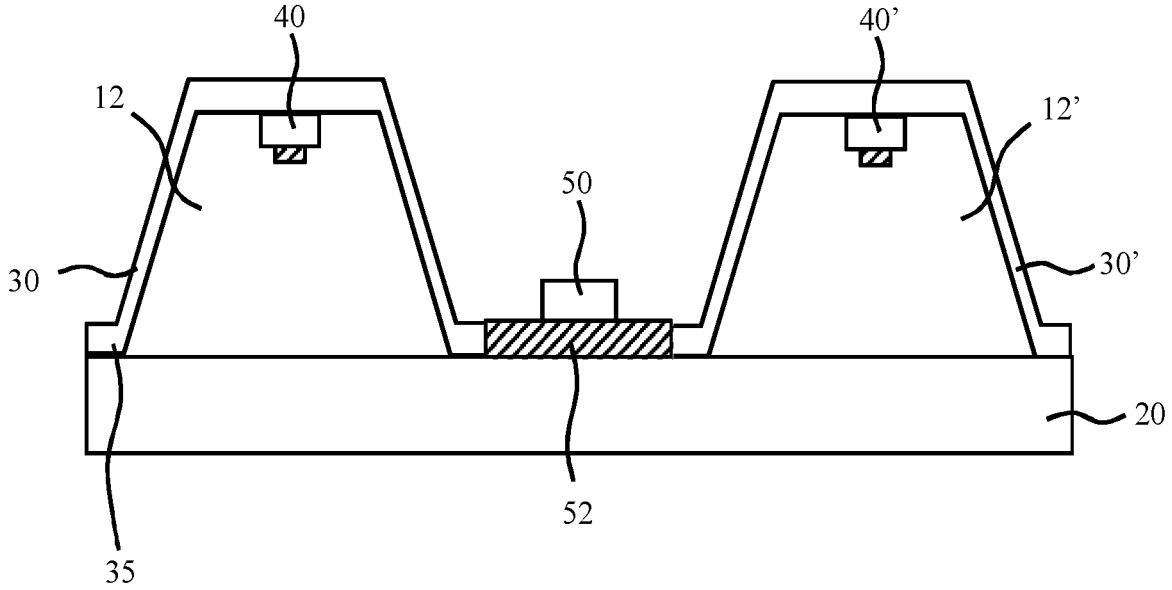
FIG. 6 schematically depicts a luminaire according to yet another example embodiment.

In FIG. 1-5, the luminaire 10 comprises a single luminaire volume 12 in which at least the one or more light engines 40 are housed. FIG. 6 schematically depicts an alternative example embodiment in which the luminaire housing comprises a first luminaire volume 12 delimited by a first region of the light exit structure 20 and a first portion of the container 30 or by a first container 30 and a second luminaire volume 12' spatially separated from the first luminaire volume 12. The second luminaire volume 12' is delimited by a second region of the light exit structure 20 and a second portion of the container 30 or a second container 30'. A first light engine 40 is disposed in the first luminaire volume 12 and a second light engine 40' is disposed in the second luminaire volume 12'.

The driver 50 when present may be located in any suitable location, such as outside the housing in between the first luminaire volume 12 and the second luminaire volume 12'. The driver 50 may be mounted directly on the light exit structure 20, e.g. in case of separate covers 30, or on a separate structure 52, e.g. an opaque structure to hide the driver 50 from view and to block light coming from the light engines 40, 40'. The separate structure 52 may form part of the container 30, for example where the container 30 is shaped to delimit both the first luminaire volume 12 and the second luminaire volume 12'.

This embodiment for instance may be used to provide a luminaire 10 in which only parts of the light exit structure 20, i.e. the first and second regions, are arranged to be transmissive, for instance to meet design and/or aesthetic requirements, to reduce the area of the light engines 40 on the container 30, e.g. PCB and/or LED area, and so on. As an alternative or in addition to the further structure 52, the light exit structure 20 may be only translucent, e.g. transparent, in selected regions, e.g. the first and second regions opposite of the light engines 40 and 40'. This may be achieved in any suitable manner, for instance by application of an opaque coating or film such as a sticker on the regions of the light exit structure 20 intended to be opaque.

Figure 7:
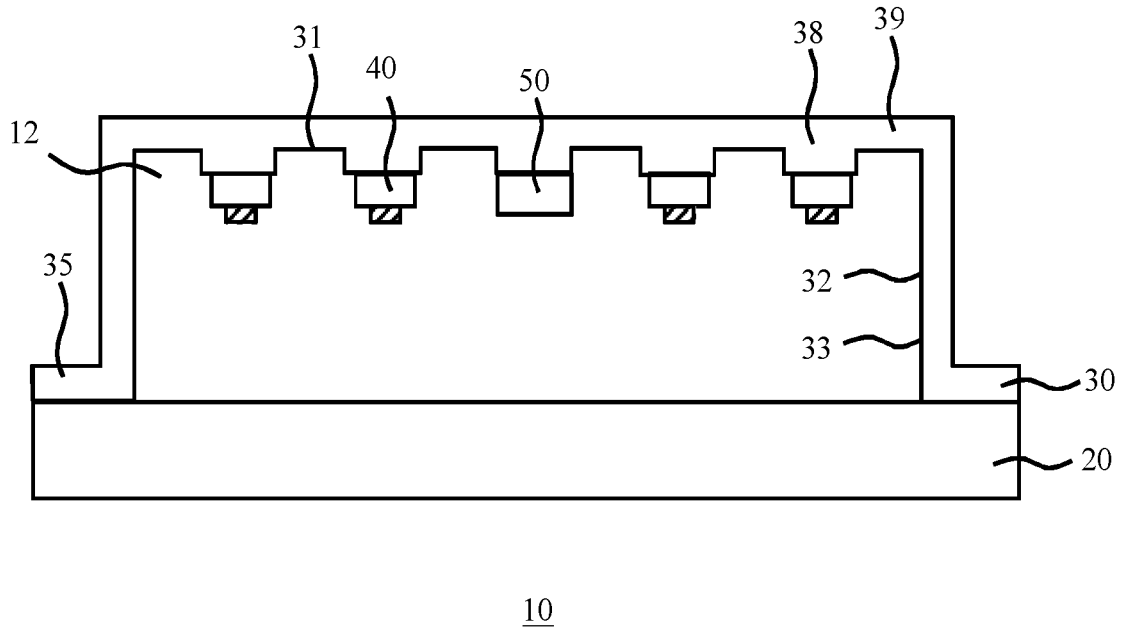
FIG. 7 schematically depicts a luminaire according to yet another example embodiment.

In FIG. 1-6, the container 30 is shown to have a substantially uniform thickness. FIG. 7 schematically depicts an alternative example embodiment in which the cover 30 has one or more first regions 38 and one or more second regions 39, wherein the first regions 38 have a greater thickness than the second regions 39 in order to provide one or more reinforced mounting platforms for components to be mounted on the container 30, such as one or more light engines 40 or a driver 50 when mounted on the container 30, e.g. inside the luminaire volume 12. The first regions 38 and the second regions 39 may form an alternating pattern of regions in a main surface 31 and/or in a side surface 33 of the container 30. Such regions of different thickness may be provided in any suitable manner, e.g. thermoforming of polymer containers 30, deep drawing of metal containers 30, pressing with different pressures for pulp-based containers 30, and so on.

Figure 8:
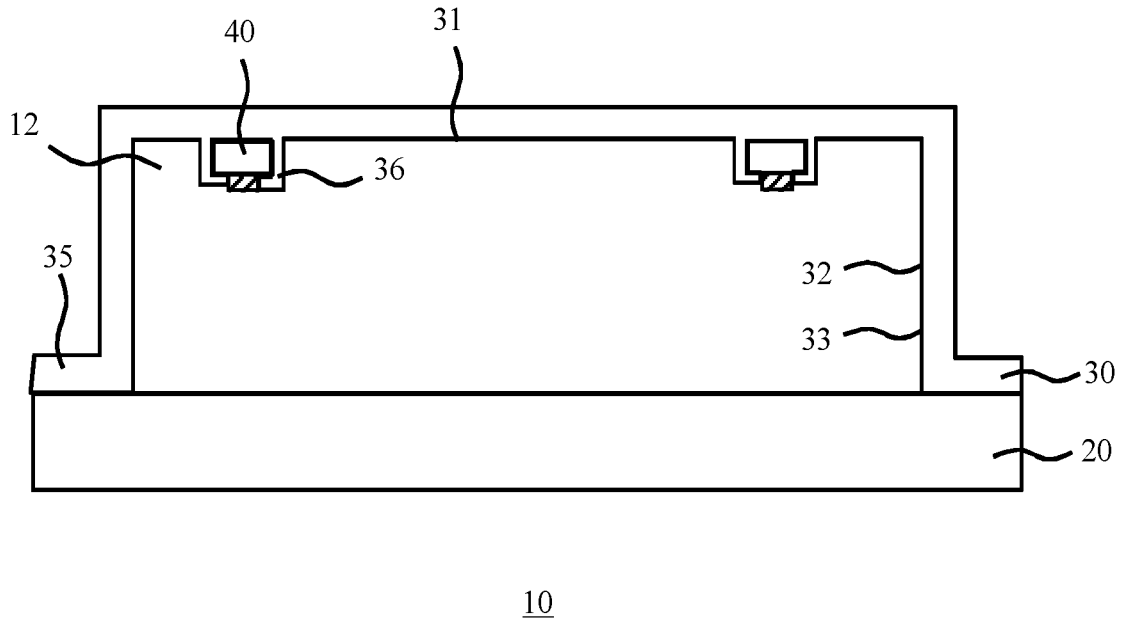
FIG. 8 schematically depicts a luminaire according to yet another example embodiment.

FIG. 8 schematically depicts another example embodiment of the luminaire 10 in which the inner surface 32, e.g. the main surface 31 and/or the side surface(s) 33, of the container 30 comprise mounting structures 36 facilitating the mounting of a component such as a light engine 40 on the inner surface 32. The mounting structures 36 are typically designed to mate with a particular component such that this component can be mounted on the inner surface 32 of the cover 30 in a straightforward manner, e.g. without the need to use additional mounting materials such as glue or adhesive tape. This for instance is particularly easily achieved in embodiments in which the container 30 can be created in a desired shape, e.g. using molding techniques, in which the mounting structures 36 may form part of a mold or cast from which the container 30 is formed. For example, this embodiment is particularly suitable for metal, metal alloy or polymer covers 30 formed through molding or casting. The mounting structures for example may be flexible click mechanisms, e.g. click fingers, onto which a component may be clicked, gutter-shape structures for receiving a matching mounting feature of a component, and so on.

As previously explained, the container 30, e.g. via rim or flange 35, is typically engaged with the light exit structure 20, e.g. immobilized thereon, to strengthen the container 30, i.e. increase its rigidity or structural integrity. This may be achieved in any suitable manner. For example, an adhesive may be provided in between the flange or rim 35 of the cover and the opposing perimeter of the light exit structure 20 to secure the cover 30 on the light exit structure 20. Such an adhesive for instance may be glue or double-sided adhesive tape.

Alternatively, a fixing member may be used that envelopes the flange or rim 35 of the container 30 and the opposing edge of the light exit structure 20, which has the additional advantage that the edge of the light exit structure 20 is protected from accidental damage, e.g. by an object impacting on the edge of the light exit structure 20. This is particularly beneficial where the rigid light exit structure 20 is fragile, e.g. a glass rigid light exit structure 20.

Figure 9:
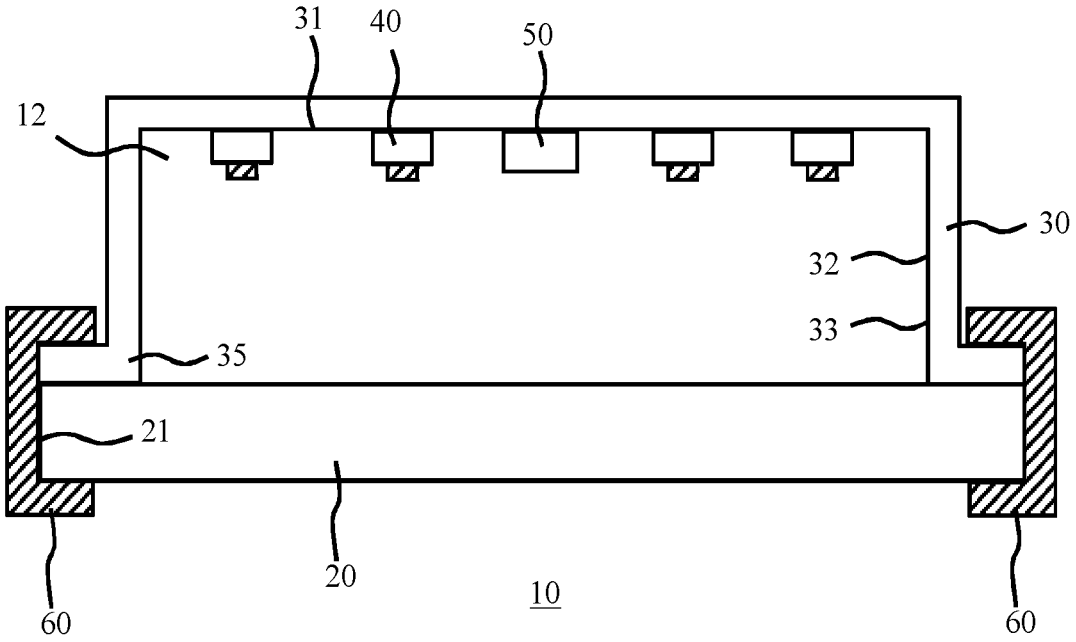
FIG. 9 schematically depicts a luminaire including fixing members according to an example embodiment.

FIG. 9 schematically depicts an example embodiment of a luminaire 10 including a fixing member 60 enveloping the flange or rim 35 of the container 30 and the opposing edge of the light exit structure 20. In FIG. 9, the fixing member 60 is a clamp that clamps the container 30 onto the light exit structure 20. Multiple clamps 60 may be used to secure the container 30 onto the light exit structure 20.

Figure 10:
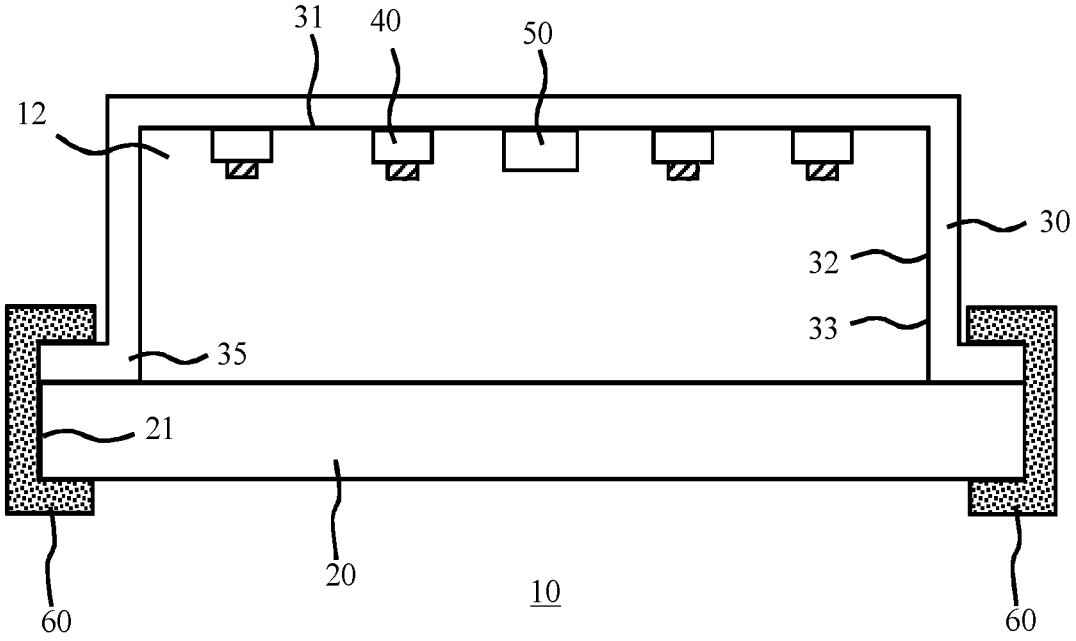
FIG. 10 schematically depicts a luminaire including fixing members according to another example embodiment.

FIG. 10 schematically depicts an alternative example embodiment of a luminaire 10 including a fixing member 60 enveloping the flange or rim 35 of the container 30 and the opposing edge of the light exit structure 20. In FIG. 10, the fixing member 60 is a ring or seal that secures the container 30 onto the light exit structure 20. The ring or seal for instance may be flexible or rigid foam, a flexible rubber ring or seal, and so on. Other fixing members 60, e.g. screws or the like, may of course be contemplated.

Figure 11:
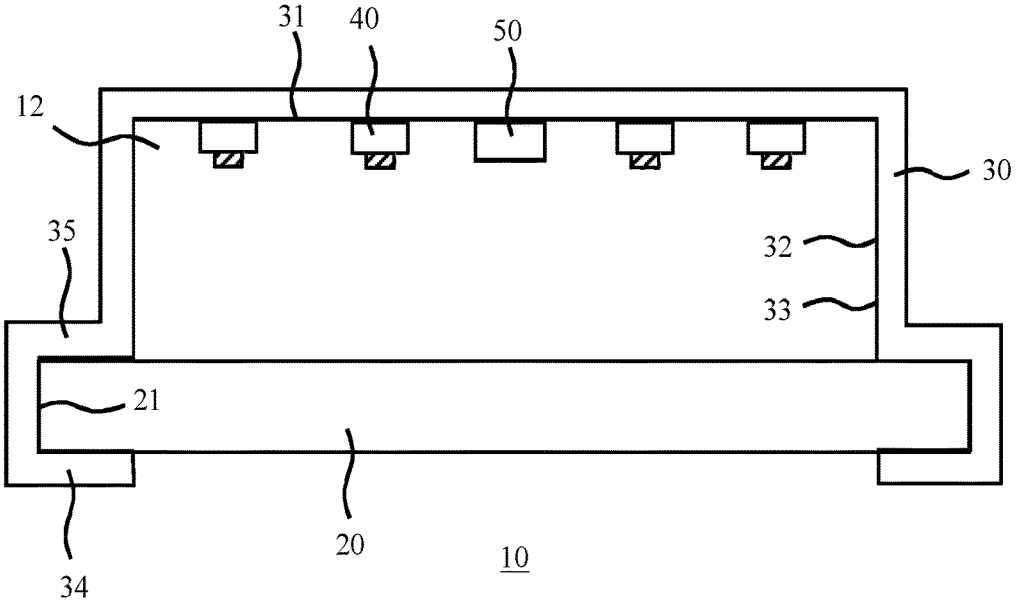
FIG. 11 schematically depicts a luminaire with a cover affixed to a rigid light exit structure according to a yet another example embodiment.

It is also feasible to secure the container 30 on the light exit structure 20 without using separate fixing members. An example embodiment of such a securing principle is schematically depicted in FIG. 11, in which the flange or rim 35 of the container 30 has a portion 34 that is folded around the light exit structure 20 to secure the container 30 on the rigid light exit structure 20. This may be achieved in any suitable manner; for example the container 30 may be pre-shaped such that the light exit structure 20 is slotted into a receiving portion of the container 30, with the receiving portion being delimited by the flange or rim 35 including the edge portion 34. Alternatively, the flange or rim 35 may be made more malleable by heating such that the heated flange or rim 35 can be folded around the light exit structure 20. Other suitable techniques for folding the edge or rim 35 around the light exit structure 20 will be apparent to the skilled person.

Figure 12:
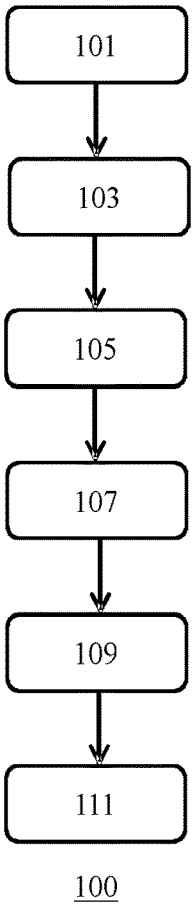
FIG. 12 is a flow chart of a method of manufacturing a luminaire according to an example embodiment.

FIG. 12 is a flow chart of an example manufacturing method 100 for manufacturing a luminaire 10 according to an aforementioned embodiment. The method 100 starts in step 101 before proceeding to step 103 in which a container 30 is shaped from a material selected from a thin film or sheet or a plant fiber-based material as explained above. The thin film or sheet may be a metal film or sheet, metal alloy film or sheet, a polymer film or sheet and so on. Due to the fact that the container 30 does not need to provide the structural integrity of the luminaire 10, the container 30 can be kept relatively thin and does not require involved processing to shape it in a desired shape. This for instance allows for the container 30 being shaped using straightforward shaping techniques, such as for example but not limited to blistering, thermoforming, deep drawing, vacuum forming, injection molding, pressure molding and so on, depending on the material(s) used for the container 30, as is well-known per se.

In step 105, a light exit structure 20 is provided, which in some embodiments may be a rigid light exit structure 20 such as a rigid glass or polymer sheet or a rigid frame including a raster of reflective segments as previously explained. For example, the glass or polymer sheet may be provided at a thickness that is sufficient to support the container 30 and improve its structural integrity, e.g. rigidity. Although step 105 is shown subsequent to step 103, it will be understood that these steps may be performed in any order, e.g. in any sequence or simultaneously.

In step 107, at least one light engine on the container 30 and/or the light exit structure 20 in any suitable manner, e.g. using a mounting member, adhesive, and so on, after which a rigid luminaire housing is formed in step 109 by engaging the container 30 with the light exit structure 20, e.g. immobilizing the container 30 on the light exit structure 20 such that the container 30 is structurally reinforced by the light exit structure 20 as previously explained, and the at least one light engine 40 is enclosed by the luminaire housing. The engaging of the container 30 with the light exit structure 20 may be done in any suitable manner, such as explained in more detail above with the aid of FIG. 9-11. After the container 30 has been secured on the light exit structure 20, the method 100 terminates in step 111.

It should be noted that the above-mentioned embodiments illustrate rather than limit the invention, and that those skilled in the art will be able to design many alternative embodiments without departing from the scope of the appended claims. In the claims, any reference signs placed between parentheses shall not be construed as limiting the claim. The word "comprising" does not exclude the presence of elements or steps other than those listed in a claim. The word "a" or "an" preceding an element does not exclude the presence of a plurality of such elements. The invention can be implemented by means of hardware comprising several distinct elements. In the device claim enumerating several means, several of these means can be embodied by one and the same item of hardware. The mere fact that certain measures are recited in mutually different dependent claims does not indicate that a combination of these measures cannot be used to advantage.

The invention claimed is:

1. A luminaire comprising a luminaire housing having at least one light engine mounted thereon, wherein the luminaire housing is delimited by a light exit structure and a container, the container having a flange surrounding an opening in the container, the flange being engaged with the light exit structure, wherein the container comprises an exterior surface, the exterior surface having a planar central section distal from the flange, the central section being opposite to and substantially parallel with the light exit structure, wherein the container is a pliable container, and wherein the light exit structure is an at least partially rigid light exit structure, in which at least the part engaging with the flange of the container restricts the pliability of the container and provides structural reinforcement to the pliable container; and wherein the pliable container is box shaped and can substantially only support its own weight and a weight of any components of the luminaire mounted thereon.

2. The luminaire of claim 1, wherein the pliable container is made of a flexible film or sheet.

3. The luminaire of claim 1, wherein the pliable container is made of a plant fiber pulp-based material.

4. The luminaire of claim 1, wherein the pliable container comprises a plurality of reinforcement ribs.

5. The luminaire of claim 1, wherein the light exit structure is a rigid light exit structure selected from a translucent or transparent sheet, said sheet being made of glass or a polymer material.

6. The luminaire of claim 5, wherein the translucent or transparent sheet comprises or carries at least one optical element for altering a luminous distribution of the at least one light engine.

7. The luminaire of claim 5, wherein the rigid light exit structure comprises a rigid frame including a raster of reflective segments.

8. The luminaire of claim 1, wherein the pliable container has a reflective inner surface facing the light exit structure.

9. The luminaire of claim 8, wherein the at least one light engine is mounted on the light exit structure and arranged to direct its luminous output towards the reflective inner surface of the pliable container.

10. The luminaire of claim 1, wherein the pliable container comprises a main surface opposite the light exit structure and at least one side surface extending from the main surface to the light exit structure, wherein the at least one light engine is mounted on one of the main surface and the at least one side surface.

11. The luminaire of claim 1, wherein the pliable container comprises a first region and a second region, the first region having a greater thickness than the second region.

12. The luminaire of claim 1, comprising:

a first luminaire volume delimited by a first region of the light exit structure and a first portion of the pliable container;

a second luminaire volume spatially separated from the first luminaire volume and delimited by a second region of the light exit structure and a second portion of the pliable container;

a first light engine disposed in the first luminaire volume; and a second light engine disposed in the second luminaire volume.

13. The luminaire of claim 1, further comprising at least one fixing member affixing the light exit structure to the container.

14. The luminaire of claim 1, wherein the pliable container has a trapezoidal box shape or a rectangular box shape.

15. A method of manufacturing a luminaire, comprising:

shaping a pliable container from a single, continuous piece of material selected from a thin film or sheet or a plant fiber-based material, the pliable container having a flange surrounding an opening in the container;

providing a partially rigid light exit structure;

mounting at least one light engine on the pliable container and/or the light exit structure; and forming a luminaire housing by engaging the flange of the pliable container with the light exit structure such that the pliability of the container is restricted by the light exit structure and wherein the light exit structure provides structural reinforcement to the pliable container, wherein the at least one light engine is enclosed by the luminaire housing;

wherein said formed luminaire housing comprises an exterior surface of the pliable container, the exterior surface having a planar central section distal from the flange, the central section being opposite to and substantially parallel with the light exit structure; and wherein the pliable container is box shaped and can substantially only support its own weight and a weight of any components of the luminaire mounted thereon.

16. The method of claim 15 wherein the pliable container has a trapezoidal box shape or a rectangular box shape.

* * * * *